United States Patent [19]

Henley, Jr.

[11] 4,150,601

[45] Apr. 24, 1979

[54] POSITIVE GRIP INSTRUMENT PICK

[76] Inventor: Horace Henley, Jr., 7505 Prairie Rd. NE., Albuquerque, N. Mex. 87109

[21] Appl. No.: 845,950

[22] Filed: Oct. 27, 1977

[51] Int. Cl.[2] ..... G10D 3/16

[52] U.S. Cl. ..... 84/322

[58] Field of Search ..... 84/258, 320–322

[56] References Cited

U.S. PATENT DOCUMENTS

| | | | |
|---|---|---|---|
| 655,959 | 8/1900 | Cochrane | 84/322 |
| 1,117,056 | 11/1914 | Knackstedt | 84/322 |
| 1,461,070 | 7/1923 | Rudesyle | 84/322 |
| 1,547,560 | 7/1925 | Burdwise | 84/322 |

*Primary Examiner*—John Gonzales

*Attorney, Agent, or Firm*—Clarence A. O'Brien; Harvey B. Jacobson

[57] ABSTRACT

An instrument pick which is designed to facilitate use by the player of a stringed instrument. The pick has a standard planar body with parallel raised surfaces attached on each side of the body. These raised surfaces are spaced a distance equal to the width of a normal human finger and thereby form a channel which the finger may rest in and is cradled by. In order to effect a secure grip of the pick, the channel formed on one face of the pick runs laterally of the pick while the channel on the opposite face runs longitudinally of the pick, thereby forcing the fingers of the user to be placed properly on the instrument pick.

8 Claims, 3 Drawing Figures

POSITIVE GRIP INSTRUMENT PICK

This invention relates in general to new and useful improvements to straight picks used to pick the strings on musical instruments.

At the present time many different sizes and shapes of picks are being used to play stringed instruments, most of which are made of plastic and are of a very slick finish {there are a few which have scored surfaces or cork laminated to them for better grip}. These picks are hard to hold, turn between your fingers and constantly need adjustments.

It is therefore the primary object of this invention to provide an improved pick with raised surfaces partially surrounding the thumb and forefinger so as to correctly align the pick with the thumb and finger at the proper angle and pick depth. At the same time these raised surfaces will prevent the rotation of the pick between the thumb and finger.

A further object of this invention is to provide a grip for an instrument pick which may be either molded intergrally with the pick or be secured to the pick by adhesive, in the latter case the angle of the pick in relation to the thumb and forefinger might be adjusted to suit the individual.

Still additional objects, benefits and advantages of this invention will become evident from a study of the following detailed description taken in conjunction with the accompanying drawing, in which.

Figure 3:
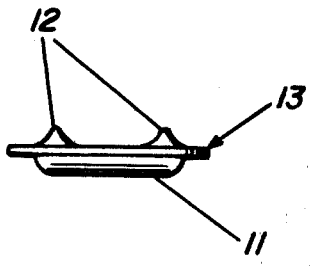
FIG. 3 is a top view showing depth of grip guides.
Figure 1:
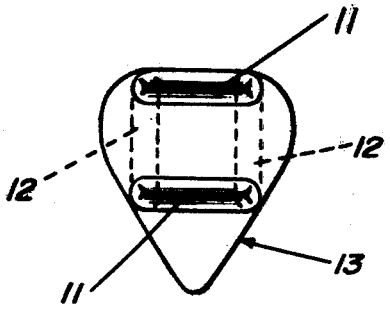
FIG. 1 is a side view of an instrument pick showing approximate angles and location of the thumb and finger grip guides.
Figure 2:
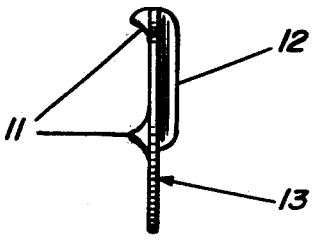
FIG. 2 is an edgewise view showing the approximate depth of the grip guides.

Referring now specifically to the drawing, and instrument pick 13 showing one of the more common sizes and configurations. A finger grip guide 12 showing approximate location and angle in relation to pick 13. A thumb grip guide 11 showing approximate location and angle in relation to pick 13.

Thumb grip guide 11 is designed to cradle the thumb in the proper angle and provide the proper distance from the thumb to the tip of the pick 13. Finger grip guide 12 is designed to cradle the forefinger in the proper angle in relation to thumb grip guide 11 and to maintain the proper location of the pick 13 on the thumb.

The operation of this device will now be readily understood. The pick 13 will be held between the thumb and forefinger with the thumb seated in thumb grip guide 11 and the forefinger seated in finger grip guide 12. By holding the pick in this manner, it should be present the proper angle and pick depth to play the instrument, and at the same time be secure against any rotation or misalignment.

While this invention has been described with particular reference to the construction shown in the drawing and while various changes may be made in detailed construction, it shall be understood that such changes shall be within the spirit and scope of the present invention as defined by the appended claims.

Having thus completely and fully described the invention, what is now claimed as new and desired to be protected by Letters Patent of the United States is:

1. A pick device for use with a musical instrument comprising: a body having two opposing faces; a first channel formed in one of said faces adapted to cradle a human finger therein; a second channel formed in said opposing face and extending transversely of said first channel and adapted to cradle a second human finger therein.

2. The device of claim 1 wherein each channel is formed by a pair of spaced parallel raised surfaces connected to a substantially flat surface of said body.

3. The device of claim 2 wherein each of said raised surfaces has a plurality of small ridges formed therein.

4. The device of claim 1 wherein said first channel extends for substantially the full width of said body.

5. The device of claim 4 wherein said second channel has a length equal to that of said first channel and extends longitudinally of said body.

6. An instrument pick having a substantially planar body with a longitudinal dimension and ending in an instrument engaging portion, a first pair of parallel elongated surfaces extending outwardly from said planar body and forming a finger engaging portion therebetween; the said surfaces being spaced from each other by a distance sufficient to enable each surface to engage opposing portions of a human finger while the finger is in contact with the planar body.

7. The pick as described in claim 6 and further including a second pair of parallel surfaces extending outward from a second side of said body and extending transversely of said first pair of parallel surfaces and spaced from each other to enable each surface to engage opposing portions of a human finger while the finger is in contact with the body.

8. The pick of claim 7 wherein said first pair of parallel surfaces extends laterally of said body for substantially the entire width of said body and said second set of parallel surfaces extends longitudinally of said body.

* * * * *